US007118298B2

(12) United States Patent
Tsutsumi

(10) Patent No.: US 7,118,298 B2
(45) Date of Patent: Oct. 10, 2006

(54) CONTAINER

(75) Inventor: Yoji Tsutsumi, Hyogo (JP)

(73) Assignee: Imex Co., Ltd., Osaka (JP)

( * ) Notice: Subject to any disclaimer, the term of this patent is extended or adjusted under 35 U.S.C. 154(b) by 315 days.

(21) Appl. No.: 10/637,610

(22) Filed: Aug. 11, 2003

(65) Prior Publication Data

US 2004/0067091 A1 Apr. 8, 2004

(30) Foreign Application Priority Data

Aug. 12, 2002 (JP) ..... 2002-235880
Dec. 27, 2002 (JP) ..... 2002-380551
Jun. 30, 2003 (JP) ..... 2003-187657

(51) Int. Cl.
*A46B 11/00* (2006.01)

(52) U.S. Cl. ..... 401/129; 401/124; 215/216

(58) Field of Classification Search ..... 401/118, 401/124, 126–130, 262, 269; 215/200, 201, 215/216, 217, 220, 305
See application file for complete search history.

(56) References Cited

U.S. PATENT DOCUMENTS 2,990,076 A * 6/1961 Stull ..... 215/46
3,559,832 A * 2/1971 Balducci ..... 215/223
4,918,520 A 4/1990 Katsuoka et al.
5,116,154 A * 5/1992 Fulkerson ..... 401/127
6,149,022 A * 11/2000 Akyildiz et al. ..... 215/222

FOREIGN PATENT DOCUMENTS

DE 491 938 2/1930
DE 29 03 401 4/1980
DE 196 29 392 8/1997
WO 99 44908 9/1999

* cited by examiner

*Primary Examiner*—David A. Scherbel
*Assistant Examiner*—Huyen Le
(74) *Attorney, Agent, or Firm*—Wenderoth, Lind & Ponack, L.L.P.

(57) ABSTRACT

A container such as a nail varnish container is provided which permits the user to quickly remove or put on the cap with a single hand without the need of turning the cap. The container includes a container body having a neck formed with a narrow hole having its top edge tapered. The neck has a tapered upper portion and a small-diameter portion connected to the bottom of the tapered upper portion to define a shoulder on the bottom. Its cap includes a cap body to be fitted on the neck. The cap body houses a vertically movable plug which can be seated on the tapered top edge of the neck, an elastic member which slides downwardly along the outer surface of the tapered upper portion and fits in the small-diameter portion and engages the shoulder, and a spring biasing the plug downwardly relative to the cap body. The cap body is provided with a disengaging means for disengaging the elastic member from the shoulder.

14 Claims, 15 Drawing Sheets

CONTAINER

BACKGROUND OF THE INVENTION

This invention relates to a container suitable for storing a liquid, powder or granular material. The container includes a cap which can be put on the mouth of the container to hermetically seal up the mouth and can be removed from the container, all in a single action with one hand. The container is also equipped with means which prevents the cap from being inadvertently removed when it is tampered with by e.g. infants.

Typical liquid containers such as bottles for nail varnish or enamel paint are required to be both watertight and airtight when capped since nail varnish is volatile. The cap usually carries a brush or other means for applying nail varnish to the nails.

A conventional nail varnish bottle comprises a bottle body having a neck and a cap detachably fitted on the tubular neck of the bottle body. The tubular neck has a vertical straight bore and is formed with male threads on its outer surface.

The cap has a female threaded inner surface adapted to engage the male threaded outer surface of the tubular neck of the bottle body, and carries a brush at the business bottom end of a shaft extending downwardly from the inner top or ceiling of the cap.

The cap is put on the neck of the bottle body with its brush inserted in the bottle through its straight bore of the neck by engaging its female threaded surface of the cap with the male threaded surface of the bottle neck until the opening of the bottle is hermetically sealed by the cap.

When using the nail varnish, the user loosens the cap, removes it to pull the brush together out of the bottle, and works the brush, which is now soaked with nail varnish, against the nails to apply varnish to them.

In order to loosen and remove the cap, the user has to hold the bottle with one hand and turn the cap with the other because it is a screw cap screwed on.

Since nail varnish is volatile, the nail varnish bottle should be hermetically closed by putting the cap back on quickly after use. On the other hand, as if on the horns of a dilemma, it usually takes a rather long time for the varnish applied to finger nails (usually applied to all the ten fingers of both hands at a time) to dry up.

In order to attach and detach the cap, it has to be turned several times or more with one hand while holding the bottle with the other hand. This is troublesome and time-consuming.

If trials are made to put the cap back on the bottle, which require the quickest possible screwing job by both hands as described above, with haste even before the varnish on the nails completely dries up, the still wet and soft varnish on one or some of the ten nails, which has been applied with elaborate efforts, may be all too often marred by inadvertently letting them touch something, no matter how much care the user exercises to put the cap back on. Thus practically, the user cannot put the cap back on until the varnish on the nails has completely dried up.

When the brush is pulled out of the bottle, excess varnish tends to be carried by the brush. It has to be removed by scraping the brush against the inside edge of the opening of the bottle neck to adjust the amount of varnish to be applied with so much time expended in doing so (delaying the time to put the cap back on). The edge of the opening is thus soiled with the scraped-off varnish. The varnish stuck along the edge of the opening will soon dry up, crust and become useless.

An object of the present invention is to provide a container such as a nail varnish container having means which permits the user to quickly remove the cap from or put the cap back on with a single hand without the need to turn the cap and without the fear of marring the elaborate finish of the varnish applied to the nails, and means for spontaneously removing excess varnish carried on the brush when the brush is pulled out of the bottle.

SUMMARY OF THE INVENTION

According to this invention, there is provided a container comprising a container body having a neck, and a cap adapted to be detachably mounted on the neck of the container body, the neck comprising a tapered upper portion having a top end and a bottom end, and a small-diameter mid-portion joined to the bottom end of the tapered upper portion to define a shoulder on the bottom end thereof, the cap comprising a cap body in which the neck can be received, a plug vertically movably supported in the cap body for closing the opening of the neck, an elastic member supported in the container body under the plug, the elastic member being slidable along the outer surface of the tapered upper portion and adapted to engage the shoulder when received in the small-diameter portion, a biasing member mounted in the cap body to bias the plug downwardly relative to the cap body, and a disengaging member mounted in the cap body for disengaging the elastic member from the shoulder.

Preferably, the elastic member is made of an elastic material and has an inner periphery defined by a major axis and a minor axis, the major axis being longer than a maximum diameter of the tapered portion when the elastic member is not stressed, the minor axis being shorter than the maximum diameter of the tapered portion and longer than a minimum diameter of the tapered portion when the elastic member is not stressed, the elastic member being designed such that when it is compressed, the major axis and minor axis are substantially equal to each other, the minor axis is longer than the maximum diameter of the tapered portion.

The disengaging member may comprise a push member slidably extending through a peripheral wall of the cap body and having its inner end connected to the elastic member at one end of the major axis, the push member being operable to compress the elastic member in the major axis direction until the major axis becomes greater than the maximum diameter of the tapered portion.

Preferably, the cap body has a cylindrical bottom portion while the container body has its top surface adapted to abut the bottom end of the cylindrical bottom portion of the cap body with the elastic member engaging on the shoulder of the tapered upper portion to stably support the cap body even if lateral force is applied to its upper portion.

The disengaging member may comprise an opposed pair of push members having their inner ends coupled to both ends of the major axis of the elastic member such that the elastic member can be compressed from both ends of its major axis.

Also, the disengaging member may comprise a push member vertically movably mounted on top of the cap body, a pair of leg members coupled to the push member so as to be vertically movable together with the push member, the leg members having wedge portions near their bottom ends, the wedge portions being adapted to wedge into between the inner wall of the cap body and the ends of the major axis of the elastic member when the push member and the leg members are pushed down, whereby compressing the elastic member in the major axis direction to such an extent that the minor axis becomes greater than the maximum diameter of the tapered portion.

Preferably, the container may further comprise a pair of link members in the form of vertically elongated plates, each of the link members having a top end coupled to the plug and a bottom end coupled to the elastic member at one end of the major axis so as to be movable together with the one end of the major axis, whereby moving the plug up and down.

Preferably, the elastic member, plug, link members and push member are integrally formed of an elastic synthetic resin.

Further preferably, a seal member may be provided on the bottom of the plug so as to engage the edge of the top opening of the neck of the container body to seal the top opening of the neck.

Also preferably, the container may further comprise a shaft extending downwardly from the bottom of the plug and carrying a brush at its tip such that the brush is inserted in the container body when the cap is put on the neck of the container body.

Preferably, a shaft extending upwardly from the top surface of the plug or downwardly from the bottom surface of the top plate of the cap body is slidably inserted in a cylindrical member extending downwardly from the bottom of the top plate of the cap body or upwardly from the top surface of the plug. Also, a spring support is provided above the plug and a compression spring is mounted between the top plate of the cap body and the spring support to bias the plug downwardly relative to the cap body.

Thus, when the cap body is put on the neck of the container body, the plug is pressed against the top end of the neck under the force of the spring, thus sealing the top opening of the neck. The seal member provided on the bottom of the plug further reliably seals the top opening of the neck.

Preferably, the hole formed in the neck has a diameter only slightly larger than the diameter of the brush so that when the brush is pulled up through this narrow hole, excess nail varnish carried on the brush will spontaneously fall off because the brush is brought into contact with the inner wall of the narrow hole. Thus, it is not necessary to remove excess nail varnish by rubbing the brush against the edge of the top opening of the neck. The edge of the top opening is thus not soiled with varnish.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Figure 1A:
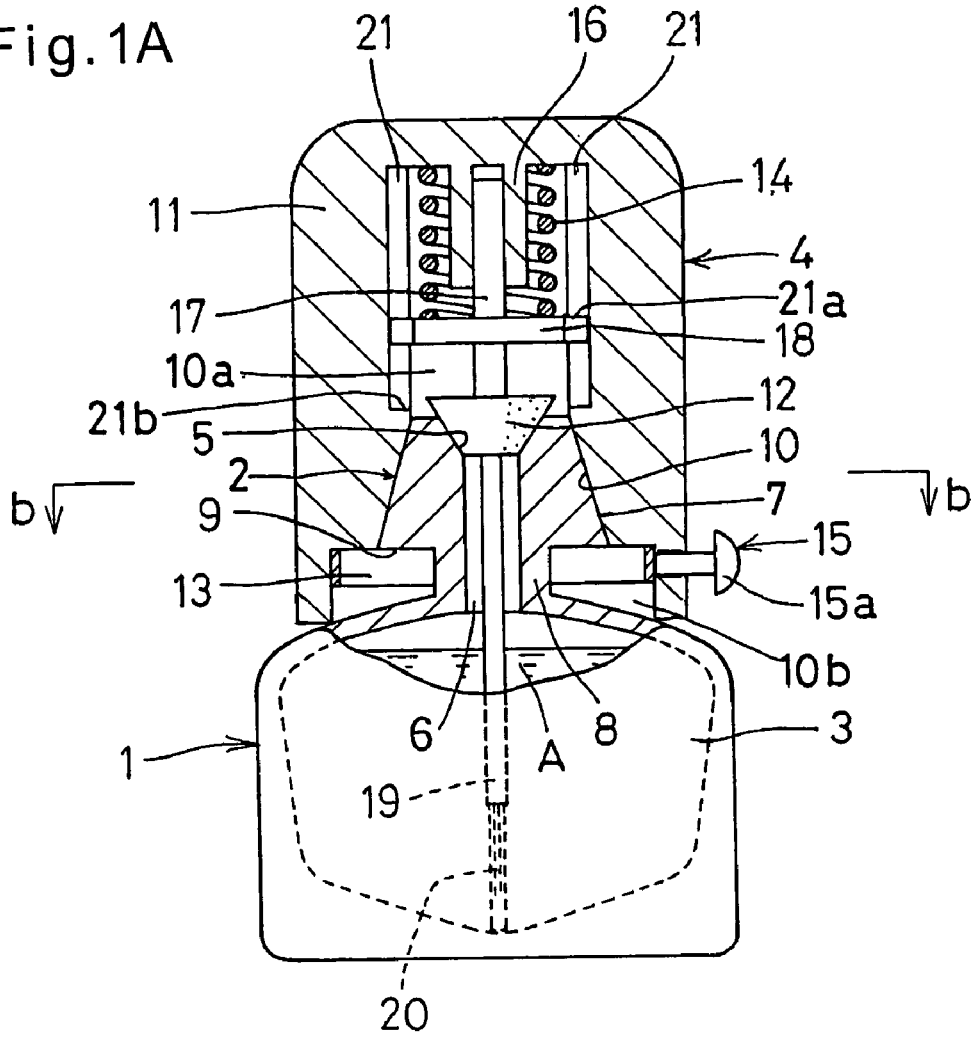
FIG. 1A is a vertical sectional front view of a container of a first embodiment of the present invention, showing its closed state.

Now referring to the drawings, the embodiments of the present invention will be described.

First, FIGS. 1A–4 show the first embodiment. A container 1 of the first embodiment comprises a container body 3 and a cap 4 adapted to be detachably put on a neck portion 2 of the container body 3 to hermetically seal the opening of the container body.

The neck portion 2 of the container body 3 comprises an upper tapered portion 7 having a truncated conical outer surface, and a lower small-diameter shaft portion 8. The bottom of the tapered portion 7 forms a shoulder 9. A straight bore 6 extends vertically through the neck portion 2. The bore 6 connects with a tapered hole 5.

The cap 4 comprises a cap body 11 adapted to be detachably fitted around the neck portion 2 from above. The cap body 11 comprises a top closed end and a peripheral wall with its bottom end having an inner truncated conical surface 10 that is complementary to the outer surface of the upper tapered portion 7 of the neck portion 2.

The cap body 11 has a cylindrical member 16 extending downwardly from its top end. In the cylindrical member 16, a guide shaft 17 is slidably received. At its bottom end, the guide shaft 17 carries a plug 12 having a substantially truncated inverted conical outer surface and adapted to be seated on the conformingly shaped chamfered upper edge of the bore 6 of the neck portion 2. At its intermediate portion, the guide shaft 17 further carries a spring support 18. A spring 14 is mounted around the cylindrical member 16 and the guide shaft 17 between the top end of the cap body 11 and the spring support 18 in a compressed state to bias the plug 12 downwardly.

The cap 4 further includes an elastic member 13 mounted to the inner surface of the cap body 11 near its bottom end. When the cap body 11 is pushed onto the neck portion 2, the elastic member 13 is annular and can pass over the tapered portion 7 and after passing the tapered portion 7, it engages the shoulder 9, thereby preventing the cap body 11 from being pulled out of the neck 2. The cap 4 further includes a disengaging means 15 provided near the bottom end of the cap body 11. By pushing in the means 15, the elastic member 13 disengages from the shoulder 9.

In an alternative embodiment, the cylindrical member 16 is secured to the top of the plug 12, the guide shaft 17 is secured to the inner top end of the cap body 11 and slidably received in the cylindrical member 16, and the spring support 18 is provided on the cylindrical member 16. In either of the first embodiment and this alternative embodiment, the spring support 18 may be omitted to support the spring 14 between the inner top end of the cap body 11 and the top of the plug 12 in a compressed state.

The spring support 18 is a substantially disk-shaped member having its outer edge in sliding contact with the inner wall of the bore 10*a* of the cap body 11. In order to prevent the plug 12 from getting out of the cap body 11, the spring 14 may have its top and bottom ends fixed to the top end of the cap body 11 and the spring support 18, respectively.

Otherwise, as shown in FIG. 1A, along its outer edge, the spring support 18 may be formed with two lugs 21*a* engaged in two vertical grooves 21 formed in the inner wall of the bore of the cap body 11 and each having a bottom stopper surface 21*b*. Also, instead of the lug-and-groove arrangement, radial stopper protrusions may be provided on the inner wall of the cap body 11 to support the bottom surface of the spring support 18. In the latter two arrangements, the spring 14 does not have to be fixed to the inner top end of the cap body 11 and the spring support 18.

Figure 3:
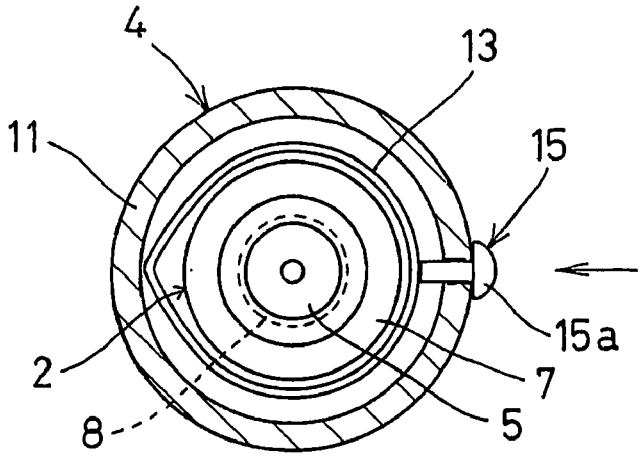
FIG. 3 is a cross-sectional view taken along line b—b of FIG. 1A, showing an elastic member disengaged from a shoulder of a tapered upper portion.
Figure 4:
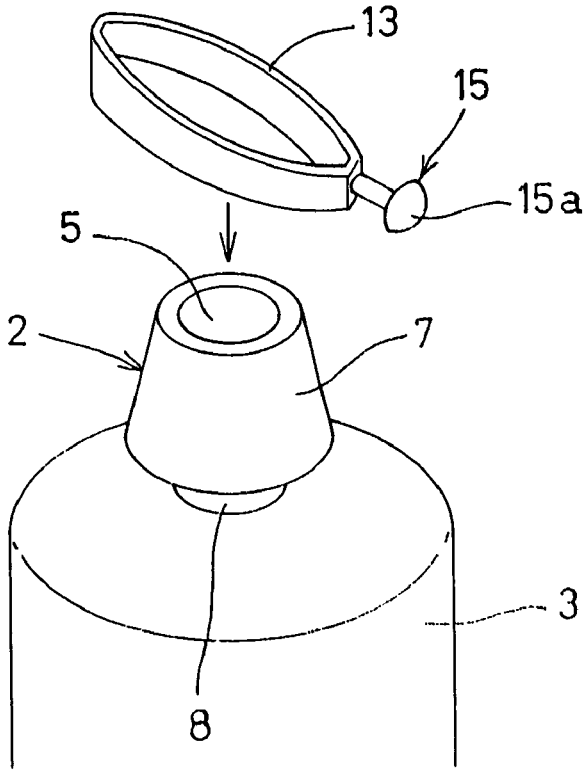
FIG. 4 is a perspective view showing the container body and the elastic member.

The elastic member 13 has a substantially oval or fusiform cross-section with its major axis substantially larger than the bottom maximum diameter of the conical outer surface of the tapered portion 7 and its minor axis larger than its top minimum diameter and smaller than its bottom maximum diameter in an unstressed state. When elastically deformed to a substantially circular shape, the inner diameter of the elastic member 13 will be larger than the bottom maximum diameter of the conical outer surface of the tapered portion 7 as shown in FIG. 3.

The elastic member 13 may be formed of two leaf springs, by bending a single leaf spring in half, or by flattening a ring spring. The elastic member 13 may be made of a resilient metal or a hard and elastic synthetic resin. If made of a synthetic resin, the member 13 can be integrally formed. The elastic member 13 is received in a large-diameter recess 10*b* formed under the tapered inner surface 10.

The disengaging means 15 comprises a radial through hole formed in the peripheral wall of the cap body 11, and a push pin 15*a* slidably received in the radial hole. The push pin 15*a* has an enlarged head at its outer end and has its inner end connected to the elastic member 13 at one end of its major axis.

The elastic member 13 is kept from coming off the cap body 11 by the push pin 15*a* while kept in contact with the inner wall of the large-diameter recess 10*b* of the cap body 11 at the other end of its major axis. In an unstressed state shown in FIGS. 1A and 1B, the elastic member 13 engages the shoulder 9, keeping the cap 4 from coming off the container body 3. When the push pin 15*a* is pushed in by pressing its head, the elastic member 13 is compressed from both ends of its major axis and deformed into a substantially circular shape having a larger diameter than the maximum diameter of the tapered portion 7 as shown in FIG. 3. In this state, the elastic member 13 disengages from the shoulder 9. The cap 4 is thus spontaneously pushed up by the force of the spring 14.

In addition to the push pin 15*a*, an extra such push pin may be provided at a position diametrically opposite to the push pin 15*a* so that the elastic member 13 can be compressed from both ends of its major axis.

The container 1 shown is a nail varnish (designated A) container. Thus, it has a brush 20. The brush 20 comprises a shaft 19 extending vertically downwardly from the bottom surface of the plug 12 and a brush 20 provided at the bottom end of the shaft 19. The brush 20 is adapted to be inserted into the container body 3 through the hole 5 of the neck portion 2 when the cap 4 is put on the container body 3. The bottom of the container body 3 is tapered downwardly from its periphery toward its center, so that the container body 3 is the deepest at the center. The brush 20 is of such a length that its tip barely touches the deepest central portion of the bottom of the container body 3 when the cap 4 is put on the container body as shown in FIG. 1A. Thus, varnish A can be used to the last drop.

The container body 3, cap body 11, plug 12 and other parts of the container 1 of the invention may be formed of any suitable material such as glass, synthetic resin, porcelain, rubber, and metal according to the kind of article to be stored in the container. For example, if the container is a nail varnish container, the container body 3 is preferably formed of glass or a synthetic resin resistant to nail varnish, and the plug 12 is formed of a material high in sealability such as rubber.

Figure 1B:
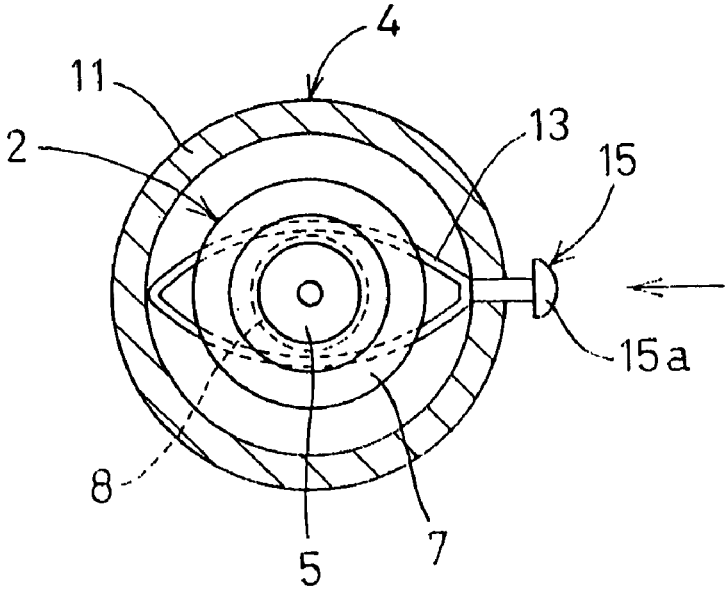
FIG. 1B is a cross-sectional view taken along line b—b of FIG. 1A.
Figure 2:
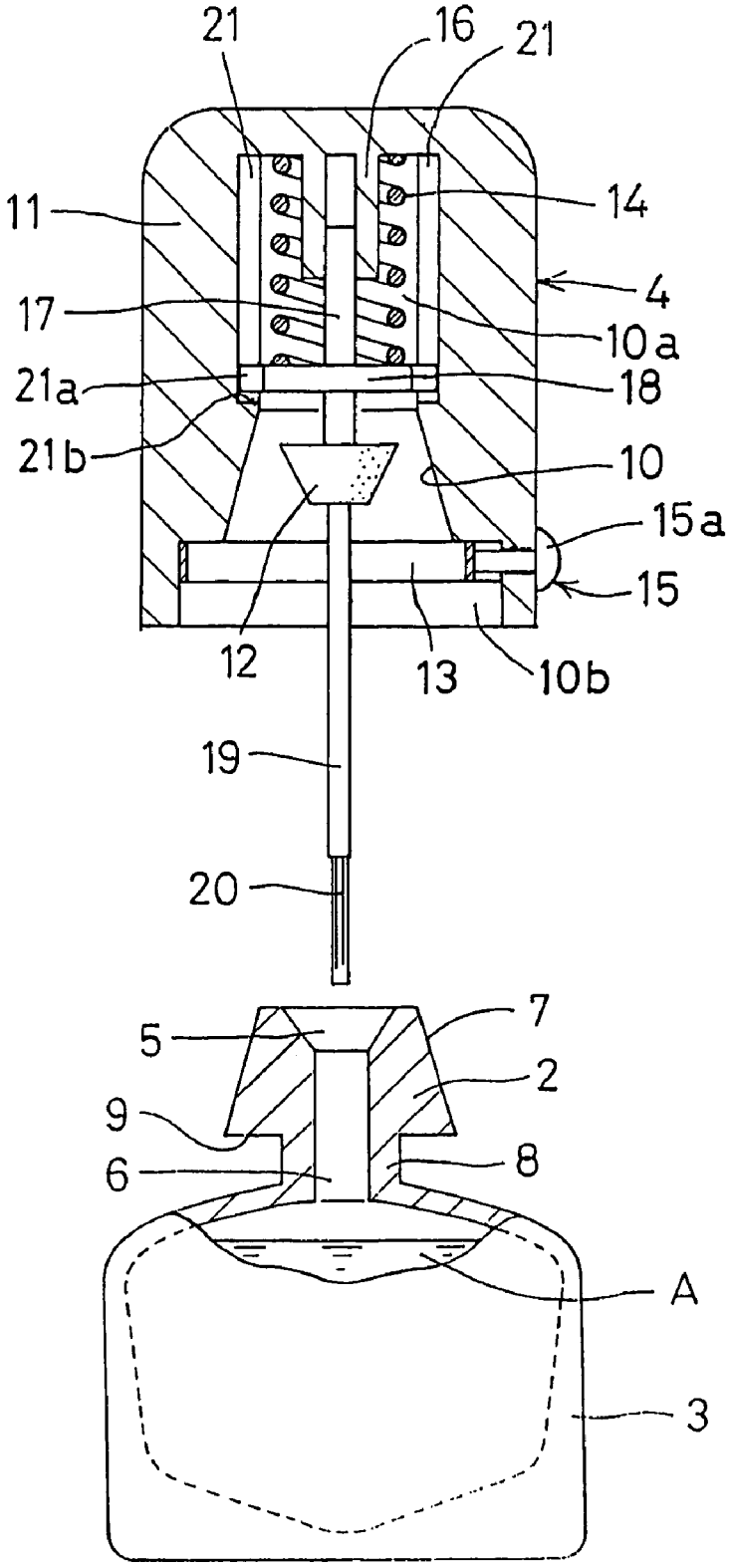
FIG. 2 is a vertical sectional front view of the same with a cap removed from a container body.

FIGS. 1A and 1B show how the container body 3 is closed by putting the cap 4 on its neck portion 2 with its tapered inner surface 10 of the cap body 11 pressed against the conical outer surface of the tapered portion 7 of the neck portion 2, the plug 12 seated in the tapered hole 5 to hermetically seal the interior of the container body 3, the spring 14 compressed, and the elastic member 13 of the cap body 11 engaging on the shoulder 9 of the neck portion 2, both ends of its minor axis abutting the small-diameter shaft portion 8, thereby keeping the cap body 11 from coming off.

For use, the push pin 15*a* is pushed in with a fingertip. The elastic member 13 is compressed from both ends of its major axis and deformed into the shape of a ring having a greater inner diameter than the bottom maximum diameter of the tapered portion 7 (FIG. 3). The elastic member 13 thus disengages from the shoulder 9, so that the cap body 11 is pushed up under the force of the spring 14 together with the elastic member 13, which is raised to a level higher than the shoulder 9.

When the finger is released from the push pin 15*a*, the elastic member 13 tends to return to its original oval shape by its own resiliency and presses hard against the conical outer surface of the tapered portion 7. This pressing force and the force of the spring 14 act as a driving force for further pushing up the elastic member 13 and thus the cap body 11 slides up along the conical outer surface of the tapered portion 7, thereby separating the plug 12 from the tapered hole 5.

In this state, simply by further raising the cap, the brush 20 can be pulled out of the container body 3. When the brush passes the narrow bore 6, it is squeezed by the inner wall of the hole, so that excess varnish is scraped off the brush. Thus, there is no need to rub the brush 20 against the edge of the mouth of the container body 3 to scrape off excess varnish. This increases the varnish applying efficiency.

The shaft 19 of the brush 20 is fixed to the plug 12, which is in turn secured to the guide shaft 17, which is stably received in the fairly long cylindrical member 16 and also supported on the inner wall of the container body 3 through the spring support 18. The brush 20 is thus stably and nonpivotally supported by the container body. Nail varnish can thus be applied to nails in a stable manner.

When the finger is released from the push pin 15*a*, the elastic member 13 will return to its original oval shape by its own resiliency.

When varnish has been applied to nails, the user simply pushes the cap 4 onto the neck 2 of the container body 3 while inserting the brush 20 in the hole 6. As the cap body 11 is pushed onto the neck portion 2, the elastic member 13 first engages the tapered portion 7, and then the plug 12 is seated in the tapered hole 5. When the cap body is further pushed in after the plug 12 has been seated on the neck portion 2, the spring 14 is now compressed. Once the elastic member 13 has passed the maximum-diameter bottom end of the tapered portion 7 and engages the shoulder 9, the cap body 11 is trapped in a closed position with the plug 12 sealing the tapered hole 5.

Thus, the cap 4 can be removed from the neck portion 2 of the container body 3 simply by pushing in the push pin 15*a* with one finger. The cap 4 can be put on the neck portion 2 of the container body 3 simply by pushing it onto the neck portion 2 with one or two fingers of one hand. Thus, the cap 4 can be removed from and put on the container body 3 with one hand. Thus, even when nail varnish applied to nails is still wet, the cap can be put on the container body without even the slightest possibility of marring the still wet varnish on nails by contact with something.

The container 1 of the embodiment is a finger nail varnish container. But it may be a container for any other liquid such as toe nail varnish or varnish remover, or a substance other than a liquid, such as powder. In addition to the push pin 15*a*, an extra such push pin may be provided diametrically opposite to the push pin 15*a* so that the elastic member can be compressed from both ends of its major axis.

FIGS. 5–8 shows a container of the second embodiment. Elements identical or similar to those in the first embodiment are denoted by identical numerals and their description is omitted.

The container 1 of the second embodiment includes a container body 3 having a neck portion 2 which comprises a substantially conical upper portion 31, a small-diameter mid-portion 32 and a large-diameter lower portion 33. A shoulder 9 is formed on the bottom of the conical upper portion 31 around the top end of the mid-portion 32. The container body 3 has a flat shoulder around the bottom end of the large-diameter lower portion 33.

A cap 4 includes a cap body 11 having a hollow space 34 which loosely receives the neck 2 of the container body 3. The cap body 11 includes a bottom cylindrical portion 35 adapted to be fitted around the large-diameter lower portion 33 of the container body 3 with its bottom end in abutment with the flat shoulder when the cap body 11 is put on the neck 2 of the container body 3.

The members 14, 16, 18, and 21 are identical in structure to the counterparts of the first embodiment, and cooperate with each other to vertically movably support a plug 36. The plug 36 is a disk vertically movably mounted in the space 34 and having a diameter equal to or slightly larger than the outer diameter of the top end of the conical upper portion 31. It includes on its bottom surface a land portion 37 having such a diameter as to be pushed into the top opening of the conical upper portion 31 when the plug 36 is pushed downwardly. Spaced downwardly from the plug 36, an elastic member 13 is received in the hollow space 34. A means 15 for disengaging the elastic member 13 comprises push pins 15*a* slidably received in diametrically opposed radial holes formed in the cylindrical portion 35 of the cap body 11.

Figure 8:
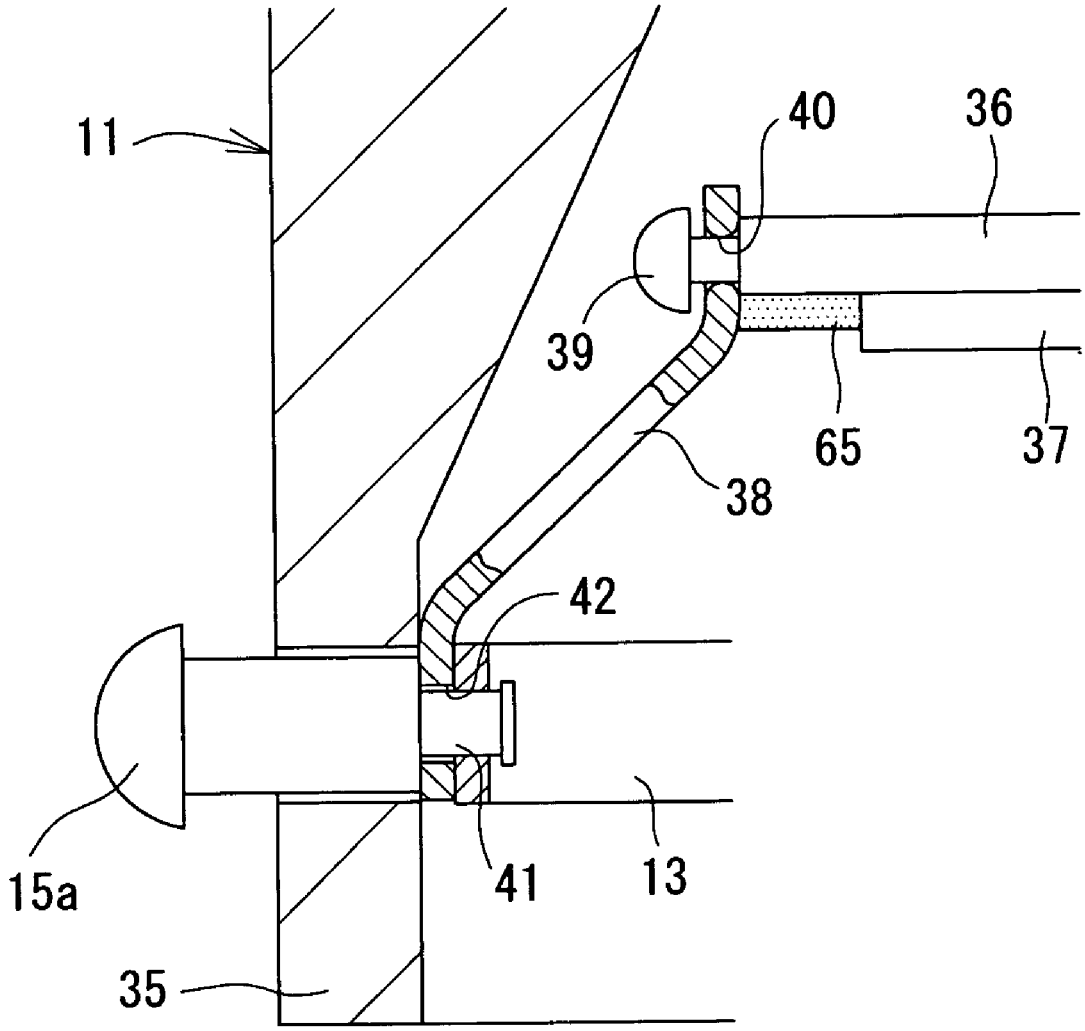
FIG. 8 is an enlarged, partial vertical sectional view of the cap of the second embodiment, showing how the elastic member is coupled to the plug through the link members.
Figure 9A:
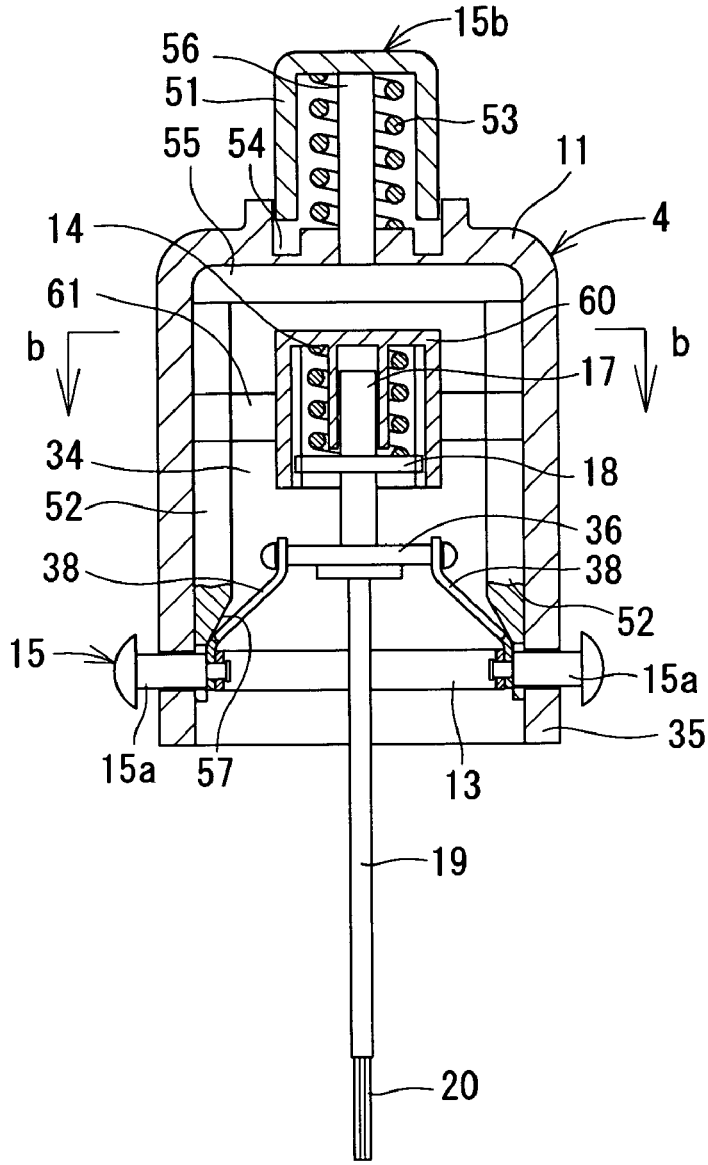
FIG. 9A is a vertical sectional front view of a cap of the container of a third embodiment.
Figure 9B:
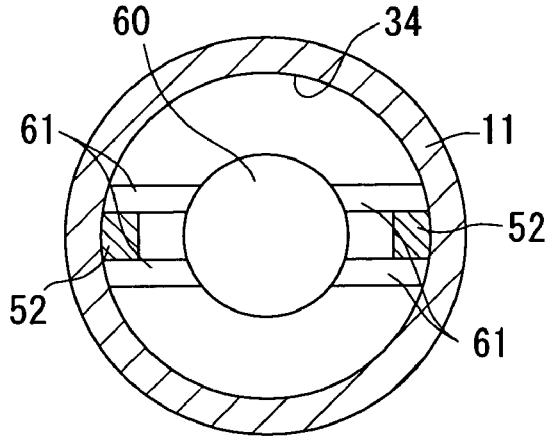
FIG. 9B is a cross-sectional view along line b—b of FIG. 9A.

The elastic member 13 and the plug 36 are coupled together by an opposed pair of link members 38 which are elongated strips such as leaf springs. As shown in FIG. 8, each link member 38 has its top end coupled to the plug 36 by inserting a push pin 39 into a pin hole 40 formed in the link member 38 at its top end, and its bottom end coupled to the elastic member 13 at one end of its major axis by inserting a small-diameter tip 41 of the push pin 15*a* into a pin hole 42 of the link member 38 formed at its bottom, and fixing the end of the small-diameter tip 41 of the push pin 15*a* to the elastic member 13. In this state, the bottom end of each link member 38 is sandwiched between the large-diameter portion of each push pin 15*a* and the elastic member 13.

When the push pins 15*a* are pushed in, the bottom ends of the link members 38 are moved radially inwardly. As a result, their top ends will rise together with the plug 36. When their bottom ends are moved inwardly, their top and bottom ends pivot with respect to the push pins 39 and 15*a*. To allow such pivoting motion of the link members 38, the pin hole 40 of each link member 38 has a slightly larger diameter than the push pin 39 or has a semicircular vertical section as shown in FIG. 8. For the same purpose, the bottom pin hole 42 of each link member 38 has a slightly larger diameter than the push pin 15*a*.

Figure 5:
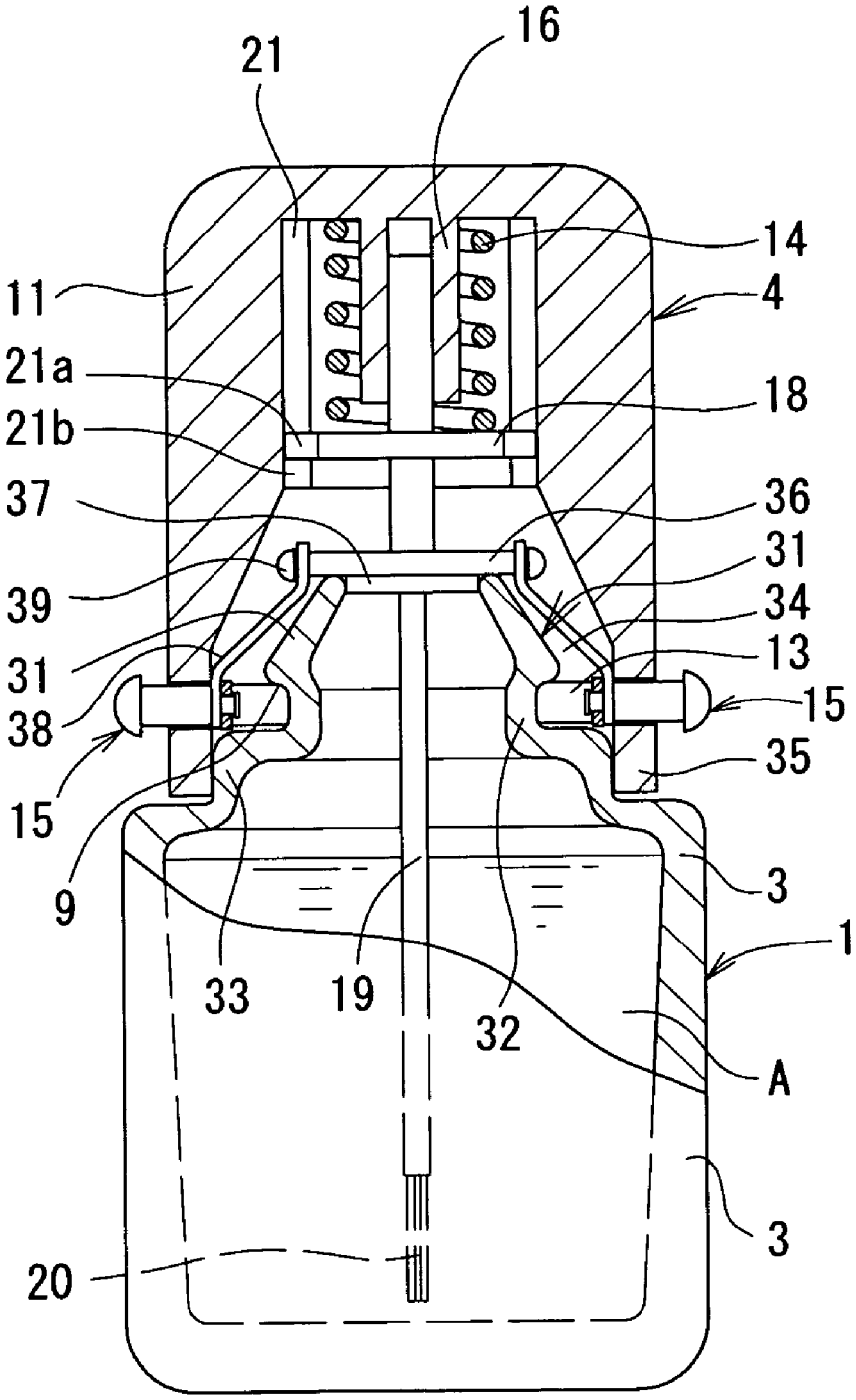
FIG. 5 is a vertical sectional front view of a container of a second embodiment, showing its closed state.
Figure 6:
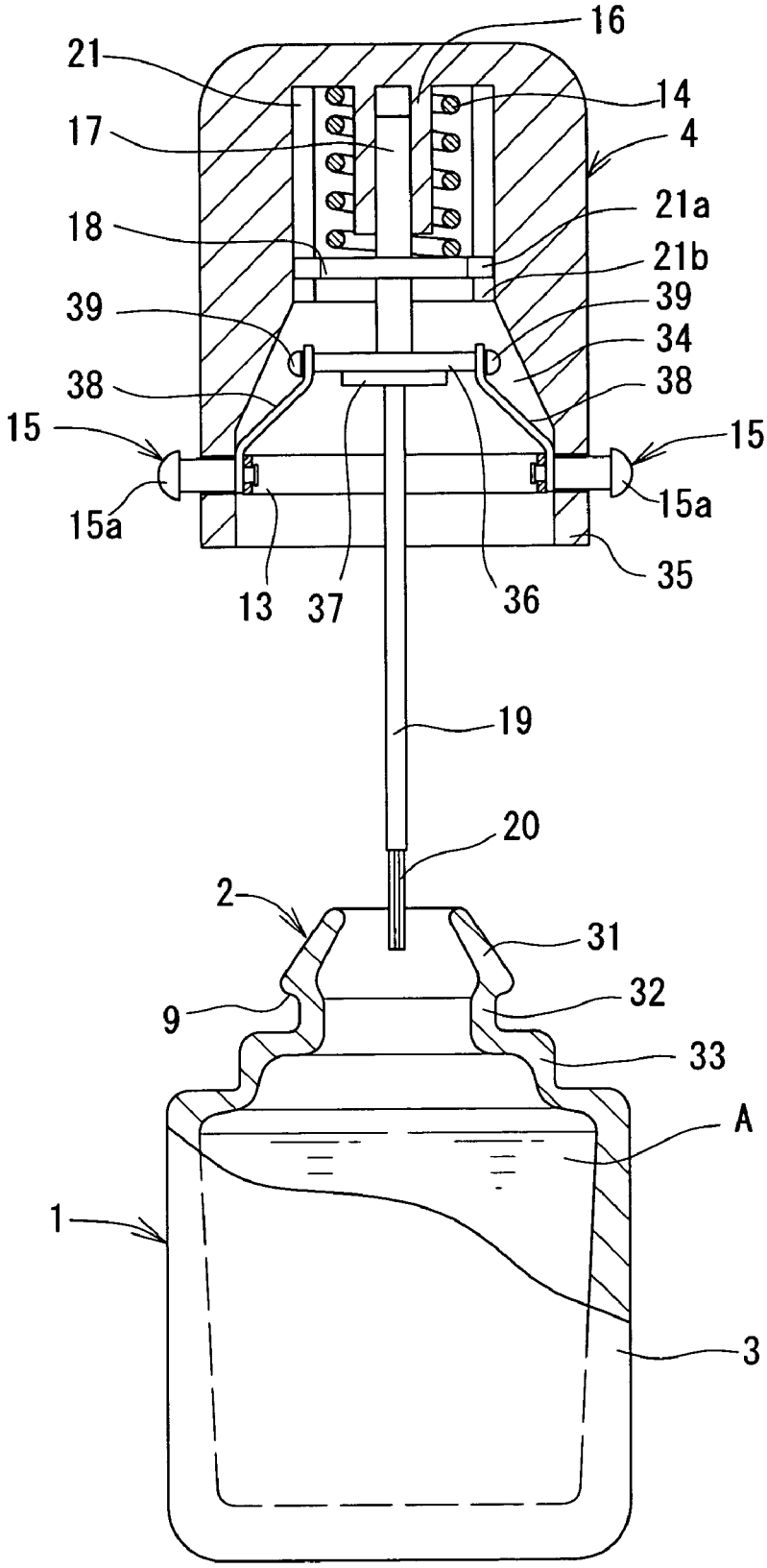
FIG. 6 is a vertical sectional front view of the same with a cap removed from a container body.
Figure 7A:
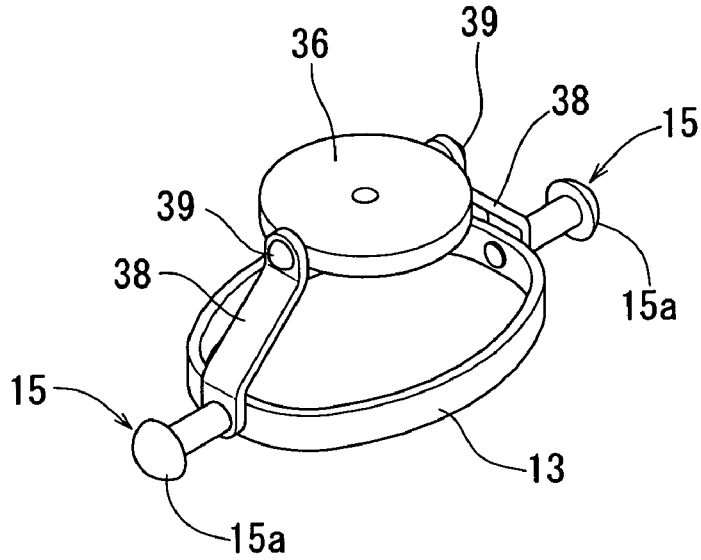
FIG. 7A is a perspective view of an elastic member and a plug, showing how they are coupled together through link members.
Figure 7B:
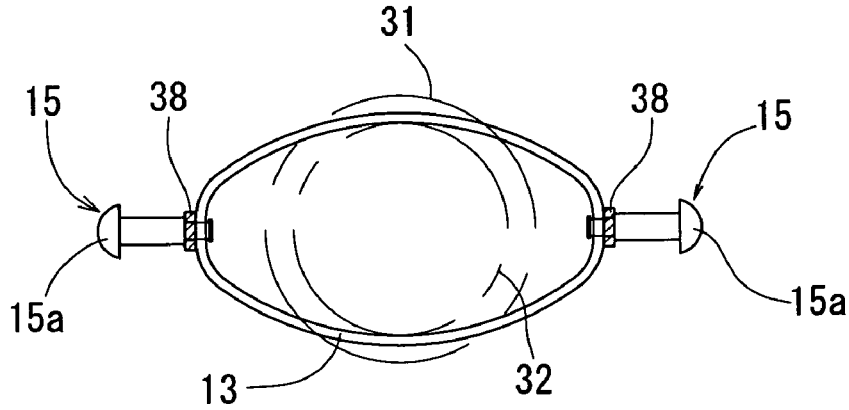
FIG. 7B is a cross-sectional view of the elastic member shown in FIG. 7A, in which the elastic member engages a shoulder of a tapered upper portion of a neck.
Figure 7C:
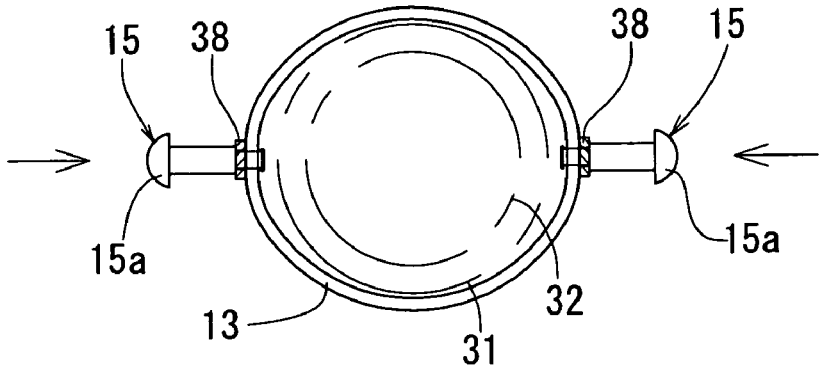
FIG. 7C is a similar view in which the elastic member has disengaged from the shoulder.

In the state of FIG. 5, the cap body 11 is put on the neck 2 of the container body 3 with the elastic member 13 received in the small-diameter mid-portion 32 of the neck 2 while engaging the shoulder 9 of the conical upper portion 31. In this state, the plug 36 is biased downwardly by the spring 14 and pressed against the top end of the conical outer portion 31, thereby closing the top opening of the container body 3. Also, the cap body 11 has its bottom cylindrical portion 35 pressed against the outer surface of the large-diameter portion 33, thereby keeping the cap body 11 from coming off the neck 2 in cooperation with the elastic member 13.

In this state, the elastic member 13 biases the bottom ends of the link members 38 radially outwardly, thereby pulling down the plug 36 through the link members 38. Thus, the plug 36 is pushed down by the spring 14 and also pulled down by the elastic member 13, so that it is pressed hard against the top end of the neck 2.

To use nail varnish A in the container body 3, the push pins 15*a* are simply pushed in with two fingers of one hand.

This causes the elastic member 13, which is substantially in an oval shape before the push pins 15*a* are pushed in, to be deformed into a substantially circular ring of which the inner diameter is greater than the bottom maximum diameter of the conical upper portion 31, and thus to disengage from the shoulder 9.

When the push pins 15*a* are pushed in, the bottom ends of the link members 38 are moved radially inwardly toward each other, so that their top ends are raised together with the plug 36. The plug 36 is thus forcibly separated from the top opening of the neck portion 2 even if it is adhered to the edge of the top opening of the neck portion 2 with varnish A working as a kind of glue.

With the push pins 15*a* kept pushed in, the cap body 11 may be raised all the way until the elastic member 13 clears the neck portion 2. Alternatively, the push pins 15*a* may be released as soon as the cap body 11 is raised to a position where the elastic member 13 is present around the bottom of the outer surface of the outer conical portion 31. When the push pins 15*a* are released in this position, the elastic member 13 tends to return to the original oval shape, thus pressing against the conical outer surface of the upper portion 31 at both ends of its minor axis. Thus, the elastic member 13 will slide spontaneously upwardly along the conical outer surface of the conical upper portion 31 under its own elastic force to the top end of the conical upper portion 31 together with the cap body 11. The cap body 11 is then further raised until the brush 20 is completely pulled out of the container body, and the varnish A carried on the brush 20 is applied to nails.

When the push pins 15*a* are released, the bottom ends of the link members are moved radially outwardly by the elastic force of the elastic member 13, so that its top end is moved down, thus pulling down the plug 36. The spring 14 also pushes down the plug 36.

When all the nails have been manicured, the cap body 11 is simply pushed down onto the neck 2 of the container body 3 with the brush 20 inserted in the hole of the neck 2. As the cap body 11 is pushed down, the elastic member 13 slides along the conical outer surface of the conical outer portion 31 while being deformed such that its minor axis increases. Simultaneously when the plug 36 abuts the top end of the neck 2, the elastic member 13 clears the bottom maximum-diameter end of the conical upper portion 31 and engages in the small-diameter mid-portion 32. The elastic member 13 is now in its original oval position, thus engaging the shoulder 9 so as not to be pulled up. As the elastic member 13 is deformed so that its major axis increases, the bottom ends of the link members are moved radially outwardly by the biasing force of the elastic member 13. Their top ends are thus pushed down together with the plug 36 until the plug 36 is pressed hard against the top end of the neck portion 2, thereby sealing the top opening of the neck portion 2.

FIGS. 9A–11B show the third embodiment. Elements identical or similar to those of the first and second embodiments are denoted by the identical numerals and their description is omitted.

The container of this embodiment includes, in addition to the disengaging means 15, a second disengaging means 15*b*. By pushing it down, the elastic member 13 can be deformed into a circular ring so as to disengage from the shoulder 9.

The second disengaging means 15*b* includes a push button 51 in the shape of a hollow cylindrical member having a closed top and its bottom end received in an annular groove 54 formed in the top surface of the cap body 11 so as to be vertically movable relative to the cap body. A shaft 56 extends downwardly from the top plate of the push button 51 and vertically slidably passes through the top plate of the cap body 11. A plate member 55 is coupled to the bottom end of the shaft 56. The plate member 55 carries a pair of legs 52 extending downwardly along the inner wall of the cap body 11 from the bottom surface thereof and having its bottom ends disposed radially outwardly of the ends of the major axis of the elastic member 13.

A compression spring 53 is mounted in the push button 51 to bias it upwardly. The bottom end of each leg 52 comprises a vertical thin flat portion 58 having a radially inner vertical, flat surface, and a wedge portion 57 connecting the upper portion of the leg 52 with the flat portion 58 and having a radially inner tapered surface connecting to the vertical flat surface of the flat portion 58. A vertically elongated hole 59 is formed in the flat portion 58 in which is inserted the large-diameter portion of each push pin 15*a* with the bottom end of each leg 52 disposed between the inner wall of the cap body 11 and the link member 38.

Since the push pins 15*a* are vertically movably inserted in the elongated holes 59, the push button 51, plate member 55 and legs 52 are vertically movable together with respect to the cap body 11 in the limited range corresponding to the movable range of the push pins 15*a* in the elongated holes 59.

When the legs 52 are in their uppermost position relative to the cap body 11, their thin flat portions 58 are disposed between the inner wall of the cap body 11 and the elastic member 13 at both ends of its major axis. When the legs 52 are pushed down by pushing down the push button 51, their wedge portions 57 will wedge into between the inner wall of the cap body 11 and the elastic member 13, thereby compressing the elastic member 13 in its major axis direction so that by the time the legs 52 are pushed down to their lowermost position, the elastic member 13 will be deformed into a ring of which the inner diameter is larger than the bottom maximum diameter of the conical upper portion 31.

Since the plate member 55 and the legs 52 are provided in the cap body 11 in this embodiment, in order to prevent the spring 14 and the plug 36 from interfering with these members, the plug 36 and the spring 14 for biasing the plug 36 downwardly are supported in a different manner from that of the first embodiment. Specifically, the guide shaft 17 carrying the plug 36 at its bottom end has its top portion slidably received in a vertical sleeve extending downwardly from the top plate of a spring case 60 having an open bottom and fastened to the inner wall of the cap body 11 through support bars 61 so as to be concentric with the cap body 11. The spring 14 is mounted around the guide shaft 17 and between the top plate of the spring case 60 and the spring support 18, which is, in this embodiment, slidable along the inner wall of the spring case 60.

In either of the second and third embodiments, in the closed position, the bottom end of the cap body 11 comes into close contact with the outer surface of the large-diameter portion 33 as shown in FIG. 5. Thus, if nail varnish A remains therebetween, they might be bonded together through the varnish present therebetween to such an extent that the cap body cannot be easily removed from the neck portion 2.

Figure 11A:
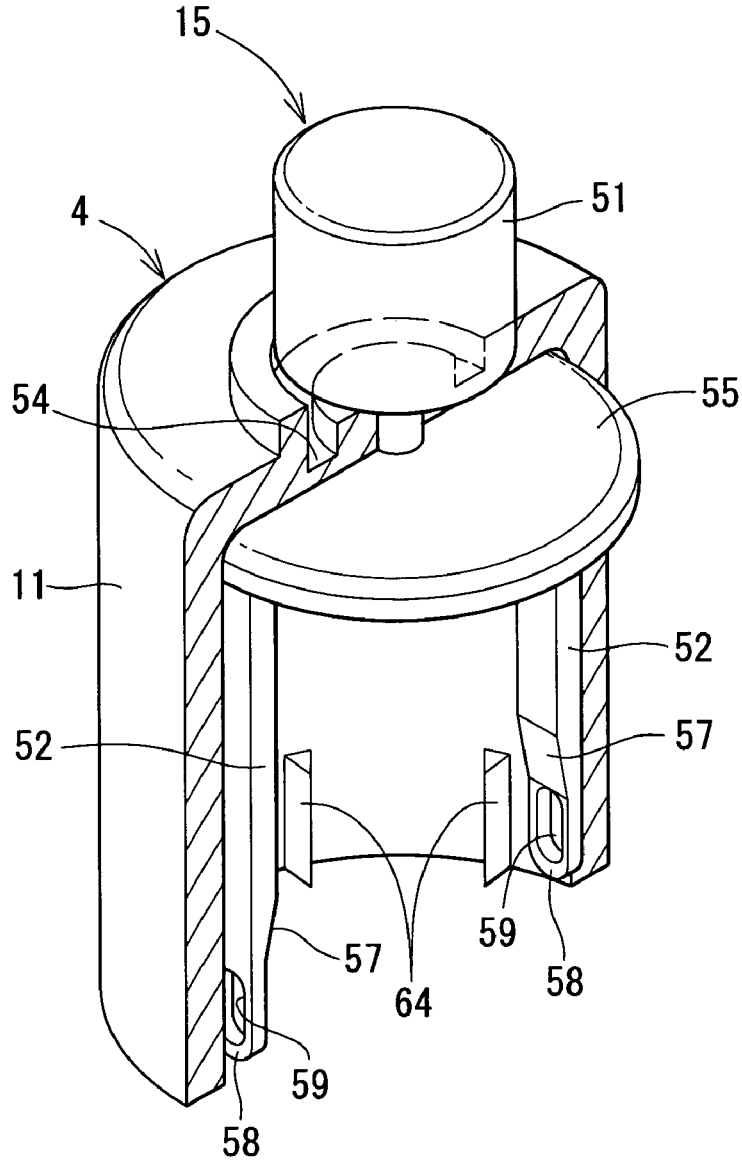
FIG. 11A is a partially vertical sectional perspective view of the cap of the third embodiment, showing its cap body and disengaging means.
Figure 11B:
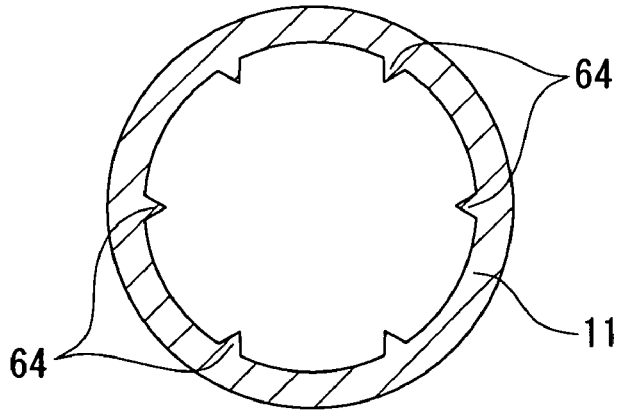
FIG. 11B is a cross-sectional plan view of the cap body near its bottom end.

Thus, as shown in FIGS. 11A and 11B, a plurality of vertical ribs 64 each having a sharp vertical ridge may be formed on the inner surface of the bottom cylindrical end of the cap body 11 to space the inner surface of the bottom cylindrical end of the cap body 11 from the large-diameter portion 33, thereby preventing them from bonding to each other with varnish.

With the neck portion 2 of the container body 3 closed by the cap 4, the push button 51, plate member 55 and legs 52 are all in their raised positions relative to the cap body 11. Other members are positioned substantially as described with reference to the second embodiment (FIG. 5) except that the flat portions 58 of the legs 52 are disposed between the inner wall of the cap body 11 and the link members 38.

To remove the cap 4, the push button 51 is pushed down with a palm of a fingertip. When it is pushed down, the plate member 55 and the legs 52 are pushed down together, so that the wedge portions 57 of the legs 52 are pushed into between the inner wall of the cap body 11 and both ends of the major axis of the elastic member 13, thereby compressing the elastic member 13 in the major axis direction to deform it into a ring having an inner diameter larger than the bottom maximum diameter of the conical upper portion 31. The elastic member 13 thus disengages from the shoulder 9. At the same time, since the bottom ends of the link members 38 move radially inwardly toward each other, their top ends will rise together with the plug 36, so that the plug 36 separates from the top end of the conical upper portion 31. In this state, the cap body 11 can be pulled out of the neck 2 by raising it while pressing the push button 51 until the elastic member 13 clears the conical upper portion 31.

Alternatively, the push button 51 may be released as soon as the cap body 11 is raised to a position where the elastic member 13 is present around the bottom of the outer surface of the outer conical portion 31. When the push button 51 is released in this position, the push button 51, the plate member 55 and the legs 52 will rise together under the resilience of the spring 53 and the wedge portions 57 will come out of between the ends of the major axis of the elastic member 13 and the inner wall of the cap body 11, so that the elastic member 13 tends to return to its original oval shape, thus pressing against the conical outer surface of the upper portion 31 at both ends of its minor axis. Thus, the elastic member 13 will slide spontaneously upwardly along the conical outer surface of the conical upper portion 31 under its own elastic force to the top end of the conical upper portion 31 together with the cap body 11. The cap 4 can be put on in exactly the same manner as the cap of the second embodiment.

In the third embodiment, the second disengaging means 15*b* is used in combination with the disengaging means 15 used in the second embodiment.

Thus to remove the cap 4, the disengaging force can be applied to the elastic member 13 through the push button 51 and the push pins 15*a*. For example, the push button 51 is pushed down with an index finger of one hand while the push pins 15*a* are pushed in with the thumb and middle finger of the same hand. Thus the elastic member 13 can be compressed more easily.

Of course, the cap can be removed with one hand, more specifically with three fingers of one hand.

However, the disengaging means 15 of the second embodiment may be omitted and only the disengaging means 15*b* of the third embodiment may be used.

Figure 12A:
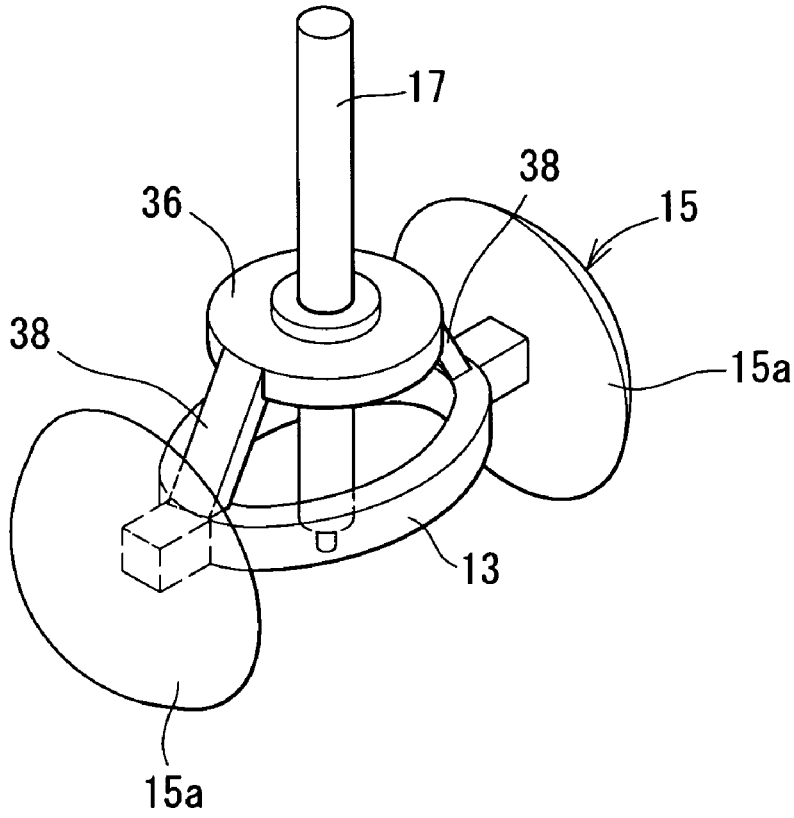
FIG. 12A is a perspective view of a fourth embodiment.

FIG. 12A shows the fourth embodiment in which the elastic member 13, plug 36, guide shaft 17, link members 38 and the push pins 15*a* of the second and third embodiments are integrally formed of a relatively hard elastomeric synthetic resin.

By integrally forming the main parts of the container out of a synthetic resin as above, it is possible to omit the steps of assembling these parts together. Also such an integral member can be more easily mounted in the cap body 11.

Figure 10A:
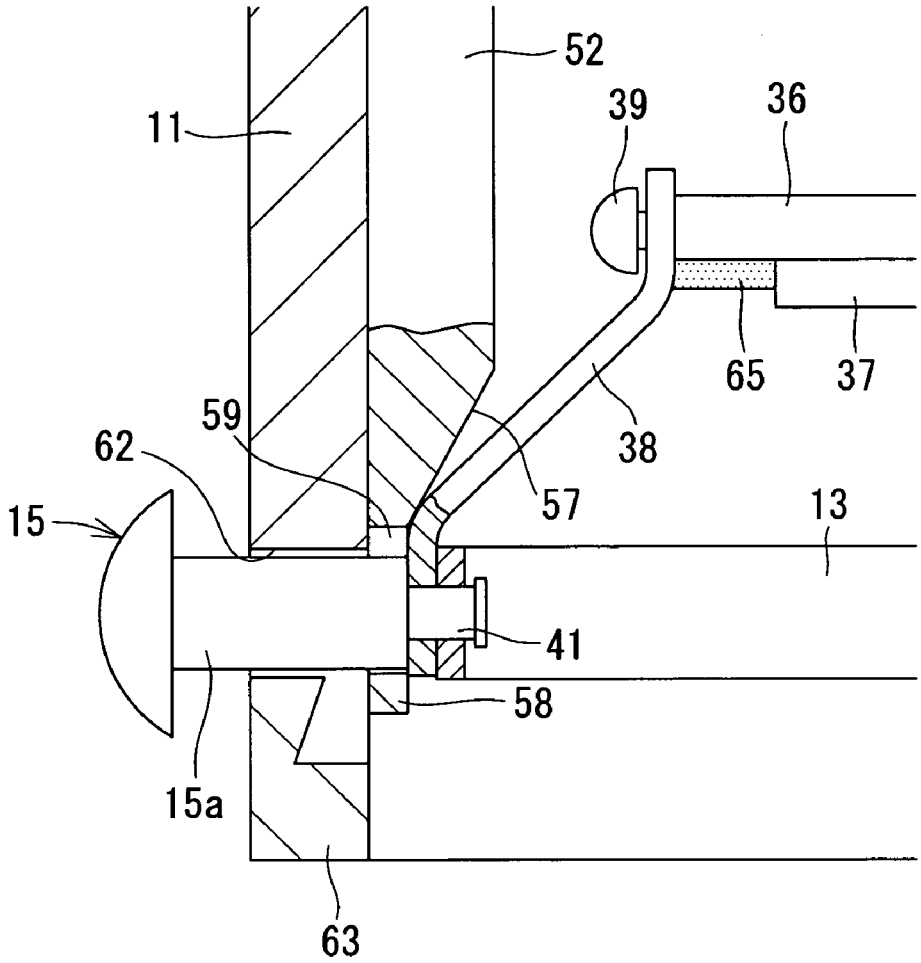
FIG. 10A is a partial enlarged vertical sectional front view of a cap of the third embodiment, showing an elastic member, plug, link member and push pin coupled together.
Figure 10B:
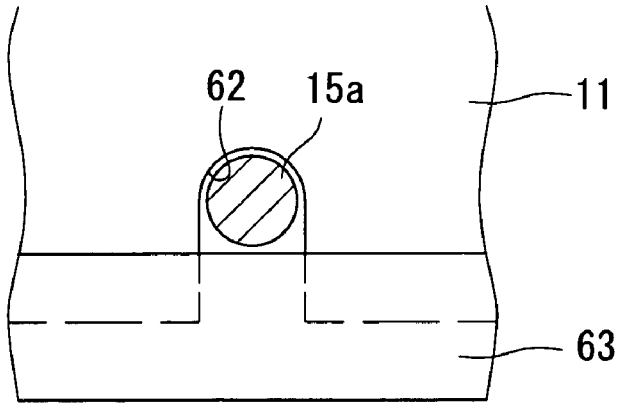
FIG. 10B is a partial vertical sectional front view of a cap body of the third embodiment, showing how a push pin is mounted to the cap body.

In order to mount this integral member in the cap body 11, pin holes 62 are formed near the bottom end of the cap body 11 to receive the push pins 15*a* as shown in FIG. 10B. They are in the form of vertically elongated holes open at the bottom edge of the cap body 11. The integral member is inserted into the cap body 11 from below until the shanks of the push pins 15*a* are received in the elongated pin holes 62. Then, a separate ring member 63 is secured to the bottom of the cap body 11 by e.g. engagement of a protrusion in a recess as shown in FIG. 10A or by bonding to close the bottom openings of the elongated pin holes 62.

The link members 38 used in the second to fourth embodiments additionally serve to reinforce and support the brush 20 more stably during manicuring.

In the second to fourth embodiments, in order to more reliably seal the top opening of the neck portion 2 with the plug 36, a seal member 65 may be provided on the plug 36 to engage the top end of the neck 2. Different such seal members 65 are shown in FIGS. 12A and 12B, FIGS. 13A and 13B, FIGS. 14A and 14B, FIG. 15, and FIGS. 16A–16C.

Figure 12B:
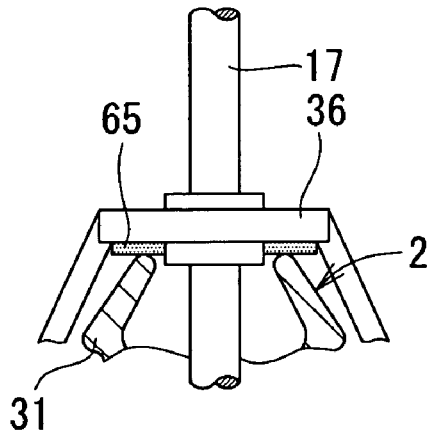
FIG. 12B is a vertical sectional front view of a plug having a seal member provided on its bottom.

The seal member 65 shown in FIG. 12B is a flat plate secured to the bottom of the plug 36 so as to engage the top end of the neck 2.

Figure 13A:
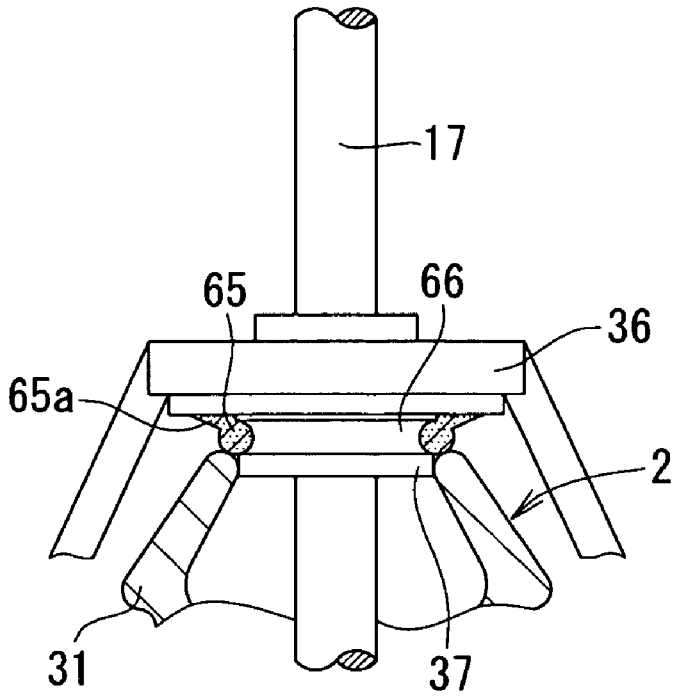
FIG. 13A is a vertical sectional front view of the plug having a different type of seal member provided on its bottom.
Figure 13B:
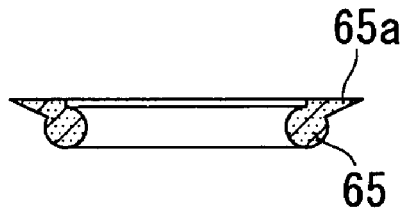
FIG. 13B is an enlarged vertical sectional front view of the seal member of FIG. 13A.
Figure 14A:
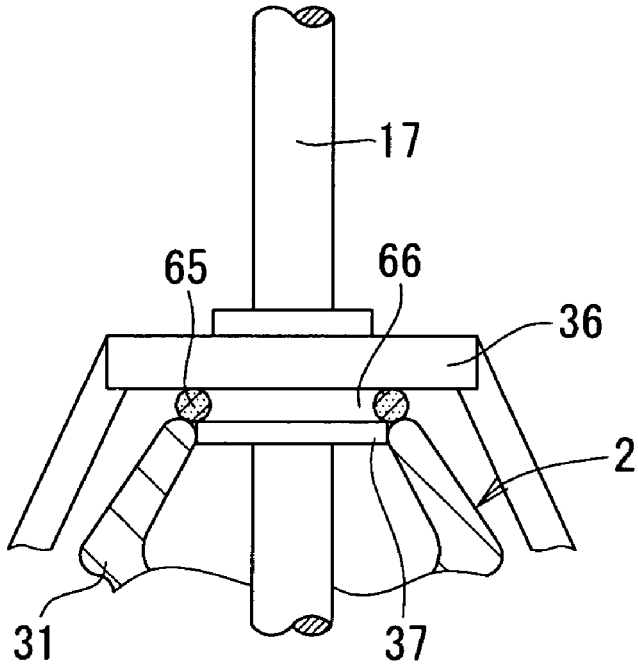
FIG. 14A is a vertical sectional front view of the plug having another type of seal member.
Figure 14B:
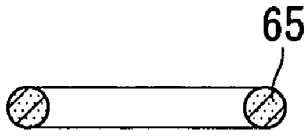
FIG. 14B is an enlarged vertical sectional front view of the seal member of FIG. 14A.

The seal member 65 shown in FIGS. 13A and 13B is an O-ring having a tongue 65*a* provided on its top and secured to the bottom of the plug 36. The seal member 65 shown in FIGS. 14A and 14B is an ordinary O-ring elastically received in an annular groove 66 formed in the side surface of the land portion 37 of the plug 36.

Figure 15:
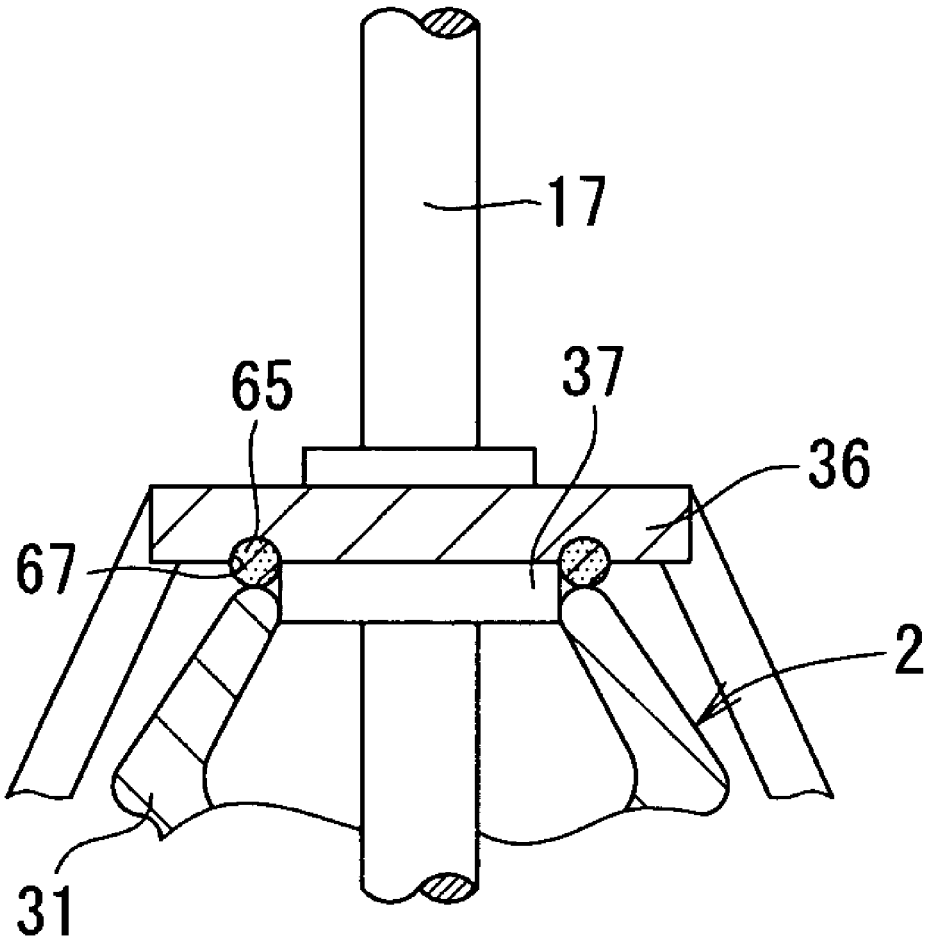
FIG. 15 is a vertical sectional front view of the plug having a still different type of seal member.

The seal member 65 shown in FIG. 15 is an ordinary O-ring having its upper half received in an annular groove 67 formed in the bottom of the plug 36.

Figure 16A:
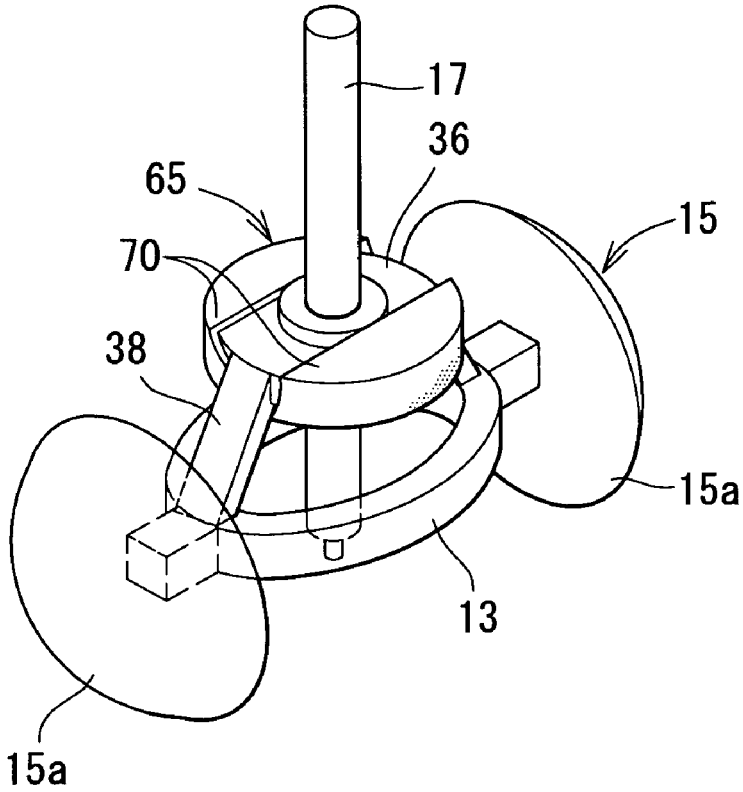
FIG. 16A is a perspective view of the plug provided with a still different type of seal member.
Figure 16B:
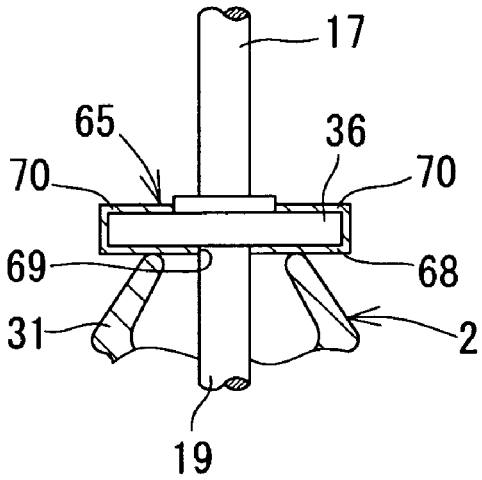
FIG. 16B is a vertical sectional view of the plug of FIG. 16A.
Figure 16C:
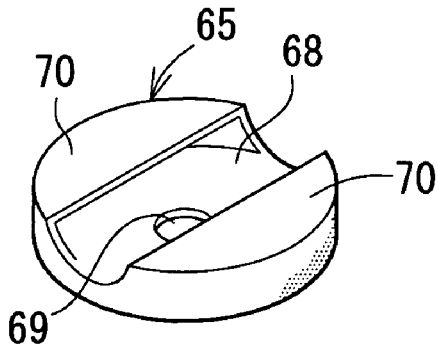
FIG. 16C is a perspective view of the seal member of FIG. 16A.

The seal member 65 shown in FIGS. 16A–16C is made of an elastic material such as rubber. It comprises a disk portion 68 adapted to be brought into contact with the bottom of the plug 36 and formed with a central hole 69 through which the shaft 19 of the brush extends, and a pair of roofs 70 spaced from each other so that the guide shaft 17 can extend therebetween and defining pockets in which both sides of the plug 36 can be received by elastically deforming the seal member.

Any of these seal members 65 is elastically compressed between the plug 36 and the top end of the neck 2 when the top opening of the neck is closed by the plug. The neck 2 can thus be more reliably sealed with the plug 36.

According to the present invention, the cap can be removed from the neck of the container body simply by pressing the push pins and/or the button with fingers or a palm of one hand and raising the entire cap. The cap can be put on the neck to close the top opening of the neck simply by pushing the cap onto the neck from above with one hand. Either operation can be carried out with one hand. Thus, the user can close the container body by putting the cap on as soon as she finishes applying nail varnish to her intended nails even while the vanish on the nails is still wet, with a minimum risk of marring her elaborate manicure work by bringing it into contact with something when putting the cap on.

Unlike the conventional screw-on type, the cap can be removed or put on simply by pressing the push pins and/or the push button without the single need of turning.

In the first embodiment, the hole formed in the neck portion has a diameter only slightly larger than the diameter of the brush. Thus, when the brush is raised through the hole, excess varnish carried on the brush will fall off when the brush rubs against the inner wall of this narrow hole. Since excess nail varnish spontaneously falls off while the brush is moving through the narrow hole of the neck, it is not necessary to remove excess varnish by rubbing the brush against the top edge of the neck. This prevents the top edge of the neck from being thickened with varnish.

In the third embodiment, the elastic member is disengaged simply by pushing down the push button. Large force can be applied when pushing down something. Further, by using the push pins of the second embodiment together with the push button of the third embodiment, the elastic member can be more easily compressed to its disengaged position.

The link members couple the elastic member with the plug such that when the elastic member is compressed in the major axis direction, the plug is raised. Thus, simultaneously when the elastic member is disengaged, the plug is forcibly separated from the top end of the neck of the container body even if the plug is bonded to the top end of the neck through e.g. dried-up nail varnish.

As shown in FIG. 12A, main parts of the container may be integrally formed of a relatively hard elastic material. Such an integrally formed member can be more easily assembled into the cap body and manufactured at lower cost.

What is claimed is:

1. A container comprising a container body having a neck, and a cap adapted to be detachably mounted on said neck of said container body, said neck comprising a tapered upper portion having a top end and a bottom end, and a small-diameter mid-portion joined to said bottom end of said tapered upper portion to define a shoulder on the bottom end thereof, said cap comprising a cap body in which said neck can be received, a plug vertically movably supported in said cap body for closing the opening of said neck, an elastic member supported in said container body under said plug, said elastic member being slidable along the outer surface of said tapered upper portion and adapted to engage said shoulder when received in said small-diameter portion, a biasing member mounted in said cap body to bias said plug downwardly relative to said cap body, and a disengaging member mounted in said cap body for disengaging said elastic member from said shoulder, wherein said elastic member is made of an elastic material and has an inner periphery defined by a major axis and a minor axis, said major axis being longer than a maximum diameter of said tapered portion when said elastic member is not stressed, said minor axis being shorter than the maximum diameter of said tapered portion and longer than a minimum diameter of said tapered portion when said elastic member is not stressed, said elastic member being compressible in the major axis direction until the minor axis of said elastic member becomes greater than the maximum diameter of said tapered portion.

2. A container as claimed in claim 1 wherein said disengaging member comprises a push member slidably extending through a peripheral wall of said cap body and having its inner end connected to said elastic member at one end of the major axis, said push member being operable to compress said elastic member in the major axis direction until the minor axis becomes greater than the maximum diameter of said tapered portion.

3. A container as claimed in claim 1 wherein said disengaging member comprises a push member vertically movably mounted on top of said cap body, a pair of leg members coupled to said push member so as to be vertically movable together with said push member, said leg members having wedge portions near their bottom ends, said wedge portions being adapted to wedge into between the inner wall of said cap body and the ends of the major axis of said elastic member when said push member and said leg members are pushed down, thereby compressing said elastic member in the major axis direction to such an extent that the minor axis becomes greater than the maximum diameter of said tapered portion.

4. A container as claimed in claim 1 further comprising a pair of link members in the form of vertically elongated plates, each of said link members having a top end thereof coupled to said plug and a bottom end thereof coupled to said elastic member at one end of the major axis so as to be movable together with said one end of the major axis, thereby moving said plug up and down.

5. A container as claimed in claim 1 wherein a seal member is provided on the bottom surface of said plug so as to engage the edge of the top opening of the neck of said container body to seal the top opening of said container body.

6. A container as claimed in claim 1 further comprising a shaft extending downwardly from the bottom of said plug and carrying a brush at a tip thereof such that said brush is inserted in said container body when said cap is put on said neck of said container body.

7. A container comprising a container body having a neck, and a cap adapted to be detachably mounted on said neck of said container body, said neck comprising a tapered upper portion having a top end and a bottom end, and a small-diameter mid-portion joined to said bottom end of said tapered upper portion to define a shoulder on the bottom end thereof, said cap comprising a cap body in which said neck can be received, a plug vertically movably supported in said cap body for closing the opening of said neck, an elastic member supported in said container body under said plug, said elastic member being slidable along the outer surface of said tapered upper portion and adapted to engage said shoulder when received in said small-diameter portion, a biasing member mounted in said cap body to bias said plug downwardly relative to said cap body, and a disengaging member mounted in said cap body for disengaging said elastic member from said shoulder, wherein said elastic member is shaped so as to have a major axis and a minor axis, and said disengaging member comprises a push member slidably extending through a peripheral wall of said cap body and having its inner end connected to said elastic member at one end of the major axis of said elastic member, said push member being operable to compress said elastic member in the major axis direction until the minor axis of said elastic member becomes greater than the maximum diameter of said tapered portion.

8. A container as claimed in claim 7 wherein said disengaging member further comprises a push member vertically movably mounted on top of said cap body, a pair of leg members coupled to said push member so as to be vertically movable together with said push member, said leg members having wedge portions near their bottom ends, said wedge portions being adapted to wedge into between the inner wall of said cap body and the ends of the major axis of said elastic member when said push member and said leg members are pushed down, thereby compressing said elastic member in the major axis direction to such an extent that the minor axis becomes greater than the maximum diameter of said tapered portion.

9. A container as claimed in claim 1 further comprising a pair of link members in the form of vertically elongated plates, each of said link members having a top end thereof coupled to said plug and a bottom end thereof coupled to said elastic member at one end of the major axis so as to be movable together with said one end of the major axis, thereby moving said plug up and down.

10. A container as claimed in claim 7 wherein a seal member is provided on the bottom surface of said plug so as to engage the edge of the top opening of the neck of said container body to seal the top opening of said container body.

11. A container as claimed in claim 7 further comprising a shaft extending downwardly from the bottom of said plug and carrying a brush at a tip thereof such that said brush is inserted in said container body when said cap is put on said neck of said container body.

12. A container comprising a container body having a neck, and a cap adapted to be detachably mounted on said neck of said container body, said neck comprising a tapered upper portion having a top end and a bottom end, and a small-diameter mid-portion joined to said bottom end of said tapered upper portion to define a shoulder on the bottom end thereof, said cap comprising a cap body in which said neck can be received, a plug vertically movably supported in said cap body for closing the opening of said neck, an elastic member supported in said container body under said plug, said elastic member being slidable along the outer surface of said tapered upper portion and adapted to engage said shoulder when received in said small-diameter portion, a biasing member mounted in said cap body to bias said plug downwardly relative to said cap body, a disengaging member mounted in said cap body for disengaging said elastic member from said shoulder, and a pair of link members in the form of vertically elongated plates, wherein said elastic member is shaped so as to have a major axis and a minor axis, and wherein each of said link members has a top end thereof coupled to said plug and a bottom end thereof coupled to said elastic member at one end of the major axis of said elastic member so as to be movable together with said one end of the major axis of said elastic member, thereby moving said plug up and down.

13. A container as claimed in claim 12 wherein a seal member is provided on the bottom surface of said plug so as to engage the edge of the top opening of the neck of said container body to seal the top opening of said container body.

14. A container as claimed in claim 12 further comprising a shaft extending downwardly from the bottom of said plug and carrying a brush at a tip thereof such that said brush is inserted in said container body when said cap is put on said neck of said container body.

* * * * *